United States Patent [19]

Anders et al.

[11] Patent Number: 4,852,441

[45] Date of Patent: Aug. 1, 1989

[54] APPARATUS FOR SLICING FOOD PIECES

[75] Inventors: Gary H. Anders, Euless; James A. Moran, Jr., Irving, both of Tex.

[73] Assignee: Frito-Lay, Inc., Dallas, Tex.

[21] Appl. No.: 76,406

[22] Filed: Jul. 22, 1987

[51] Int. Cl.[4] ..... B26D 7/06; B26D 3/28

[52] U.S. Cl. ..... 83/155; 83/395; 99/534

[58] Field of Search ..... 83/394, 395, 165, 155; 99/516, 534

[56] References Cited

U.S. PATENT DOCUMENTS

| | | | |
|---|---|---|---|
| 225,114 | 3/1880 | De Frain | 83/395 |
| 322,175 | 7/1885 | Gilchrist | 83/395 |
| 365,516 | 6/1887 | Grotholtman | 83/395 |
| 916,168 | 3/1909 | Kellam | 83/395 |
| 1,400,290 | 12/1921 | Johannes | 83/395 |
| 1,713,769 | 5/1929 | McCoy | 83/395. |
| 2,148,922 | 2/1939 | Bachofner | 146/93 |
| 2,280,053 | 4/1942 | Barnes | 83/165 |
| 2,324,874 | 7/1943 | Peters | 99/516 |
| 2,438,304 | 3/1948 | Slingerland | 146/158 |
| 2,767,752 | 10/1956 | Stahmer | 146/78 |
| 2,769,714 | 11/1956 | Stahmer | 99/100 |
| 2,807,299 | 9/1957 | Steinmetz | 83/395 |
| 3,139,130 | 6/1964 | Urschel et al. | 146/241 |
| 3,245,300 | 4/1966 | Hasten et al. | 83/355 |
| 3,310,087 | 3/1967 | Werder et al. | 83/395 |
| 4,184,423 | 1/1980 | Raque et al. | 99/537 |
| 4,372,184 | 2/1983 | Fisher et al. | 83/98 |
| 4,547,376 | 10/1985 | Silver et al. | 426/102 |

OTHER PUBLICATIONS

J. E. Grote Company, Inc. Brochure.

*Primary Examiner*—Paul A. Bell
*Assistant Examiner*—Scott A. Smith
*Attorney, Agent, or Firm*—Bernard, Rothwell & Brown

[57] ABSTRACT

Apparatus for slicing a food piece includes at least one stationary feeding channel for serially feeding food pieces. The feeding channel has a feed outlet through which food pieces pass prior to slicing thereof. At least one moving slicing assembly including a first planar support surface on which the food piece exiting the feed outlet rests prior to a slice being cut is provided, the first support surface being disposed at a distance below the feed outlet about equal to the desired slice thickness. The fixed slicing blade is maintained at a set distance from the first support surface and adjacent to the feed outlet to sever a slice from the food piece, the distance between the first support surface and the slicing blade defining a slice exit through which individual slices exit the slicing assembly. A blade holder is provided having a second planar support surface contingent to the slicing blade and extending in an opposing direction from the first support surface, on which the food piece rests while a slice is being cut. The slicing assembly further includes a slice-throwing surface for throwing slices away from the slice exit during movement of the slicing assembly past the feed outlet.

24 Claims, 10 Drawing Sheets

APPARATUS FOR SLICING FOOD PIECES

BACKGROUND OF THE INVENTION

1. Field of the Invention

The present invention relates to the field of automated slicing of food pieces and placement of the slices.

2. Description of the Background Art

High speed automated devices for slicing food pieces, such as potatoes and the like, are known in the art. One such apparatus is the Urschel Model CC, commonly utilized to slice potatoes in the commercial production of potato chips. The Urschel Model CC includes a stationary drum with peripherally mounted knives and a rotating impeller within the drum. Food pieces, such as potatoes, are fed into the drum and forced against the peripherally mounted knives by the impeller with the slices exiting the periphery of the drum. Such drum-type slicers are efficient, and are useful for producing slices which are processed after slicing as a group to form the final product, such as washing and frying of a mass of potato slices in the production of potato chips. However, due to the manner in which slices exit the periphery of the drum upon slicing, such drum-type slicers are not particularly useful for forming slices which must be separated after slicing for further processing.

For slicing elongate food pieces such as loaves of sausage, bricks of cheese and the like, another slicing approach has been utilized by the J. E. Grote Company, Inc. of Ohio. This approach utilizes a stationary horizontal slicing table, above which projects a rotating slicing blade at a slight angle with respect to the plane of the table. A vertically oriented pivoting guide tube carries the food pieces to be sliced above the slicing table and rotating blade, the guide tube including a feed outlet which is reciprocated past the upwardly extending, rotating blade to slice the food pieces at the feed outlet. The slice thickness is determined by the distance the blade extends above the slicing table, the slices dropping by gravity from the slicing blade through a slot in the slicing table adjacent the slicing blade. Grote TM slicers have been utilized to monolayer relatively thick slices of elongate food pieces by passing a conveyor beneath the slicing table onto which the slices individually fall.

A Grote-type slicer having a pivoting guide tube reciprocating past a blade angularly projecting above a stationary slicing table is not particularly well suited for slicing non-elongate food pieces such as apples, potatoes and the like at high speed, because of the considerable amount of waste generated during slicing due to the pivoting motion of the guide tubes. The Grote-type slicer does not provide means for supporting the uncut food pieces. The undesirable waste results during pivoting motion of the guide tube when the tailing of an item being sliced, such as the end of an apple, is thrown out of the tube as scrap. Although ejection of non-uniform "ends" may be desirable when slicing salami and the like, it constitutes a substantial economic waste when slicing apples or other fruits and vegetables.

There remains a need in the art for an apparatus capable of efficiently slicing non-elongate food pieces at high speeds without substantial waste, and in a manner which permits monolayering of the slices.

SUMMARY OF THE INVENTION

In accordance with the present invention, an apparatus for slicing food piece comprises at least one stationary feeding channel for serially feeding food pieces, the feeding channel having a feed outlet through which a food piece passes prior to slicing thereof. At least one moving slicing assembly is provided that includes a first substantially planar support surface on which the food piece exiting the feed outlet rests prior to a slice being cut. The first support surface is disposed at a distance below the feed outlet about equal to the desired slice thickness. Also provided is a fixed slicing blade maintained at a set distance from the first support surface and adjacent to the feed outlet to sever a slice from the food piece. The distance between the first support surface and the slicing blade defines a slice exit through which individual slices exit the slicing assembly. A blade holder having a second substantially planar support surface is contingent to the slicing blade and extends in an opposing direction from the first support surface, on which the food piece rests while a slice is being cut. The slicing assembly further includes a slice-throwing surface that extends from the slicing blade in the vicinity of the slice exit at an acute angle relative to the second planar surface for throwing slices away from the slice exit during movement of the slicing assembly. Means are provided for moving the slicing blade of the slicing assembly past the feed outlet to slice food pieces into individual slices and to throw the slices away from the slice exit with the slice throwing surface.

BRIEF DESCRIPTION OF THE DRAWINGS

The drawings illustrated various embodiments of the invention, and throughout the drawings, features of the invention having the same function bear the same reference numeral.

DESCRIPTION OF THE PREFERRED EMBODIMENTS

Figure 1A:
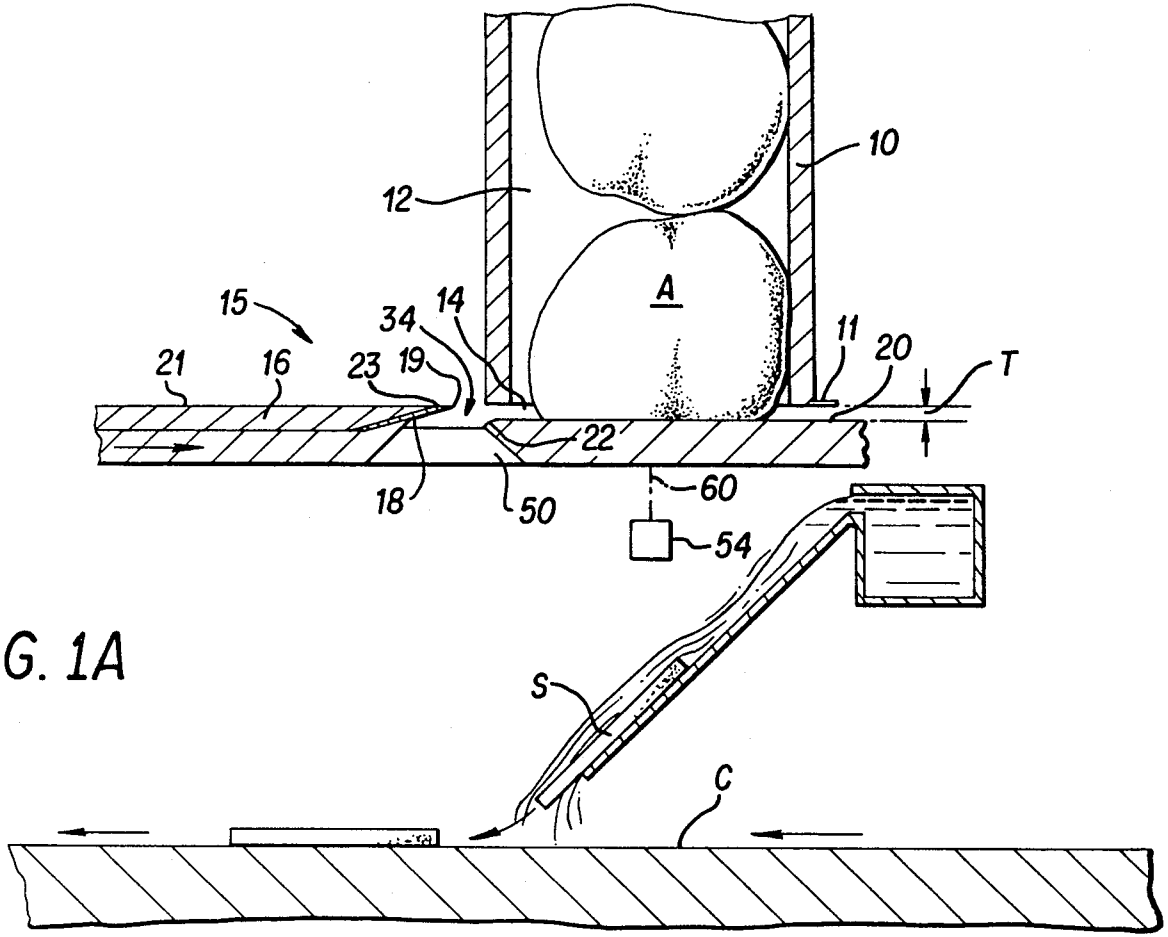
FIGS. 1A–1C are a sequence of schematic side elevation views of an apparatus according to one embodiment of the invention during the cutting and monolayering of one slice from a food piece with a rotating slicing assembly.

An apparatus according to one embodiment of the present invention includes a stationary guide tube 10 defining a feeding channel 12. See FIGS. 1A–1C. Advantageously, guide tube 10 is detachable from the apparatus for cleaning. Pieces of food to be sliced, such as apples A, are serially fed through feeding channel 12 towards a feed outlet 14 adjacent a slicing assembly, the apples passing through the feed outlet 14 during slicing of the apples. The feed channel can be substantially vertical as shown, or angled off a vertical center line by, for example, up to about 60° towards the front or back of the slicer, to take advantage of gravity feeding. If desired, a plurality of guide tubes 10 can be arranged side-by-side in a row R as shown in FIG. 2.

Referring back to FIGS. 1A–1C, a slicing blade assembly 15 according to this embodiment is moved past the feed outlet 14 to slice a food piece. Slicing blade assembly 15 includes a first planar support surface 20 on which a food piece exiting the feeding channel rests prior to being cut. Support surface 20 follows a first planar path during movement of the slicing assembly 15 past feed outlet 14 to slice a food piece.

The slicing blade assembly 15 further includes a slicing blade 18 fixed within a blade holder 16. Slicing blade 18 has a slicing edge 19 that follows a second planar path that is adjacent the feed outlet, during movement of slicing assembly 15 past feed outlet 14 to slice a food piece. The slicing edge 19 of the slicing blade 18 is beveled on a side 23 of the blade adjacent the feed outlet 14 of feeding channel 12.

The slicing assembly 15 includes a second planar support surface 21 on which the food piece rests while a slice is being cut. During slicing, support surface 21 follows the second planar path along with blade edge 19. The slicing blade edge 19 is adjacent the feed outlet 14 and the first support surface 20 is disposed at a distance below the feed outlet 14 about equal to a desired slice thickness T, such that the first and second planar paths are parallel and separated by a distance about equal to the thickness of a slice. For varying slice thickness, the distance T between the feed outlet 14 and the first support surface 20 can be adjustable, as is later described in more detail. Similarly, the distance between feed outlet 14 and blade edge 19 can be adjustable as discussed below.

The blade holder 16 with blade 18 fixed thereto are fixedly connected to the first and second planar surfaces 20 and 21, which form the upper surface of a rotating turntable 50. The first support surface 20 and the slicing blade 18 are spaced apart such that the distance between the first support surface and the slicing blade define a slice exit 34 through which individual slices exit the slicing assembly 15. The distance between the first support surface 20 and the slicing blade edge, which defines the slice exit, can for example be between about 1.3 and 3.3 mm (between about 0.05 and 0.13 inch).

Feed outlet 14 is defined at a rearward portion thereof by a fixed slicing shear bar 11 that supports the lower portion of tube 10 and cooperates with the slicing blade 18 to slice a food piece.

Figure 1B:
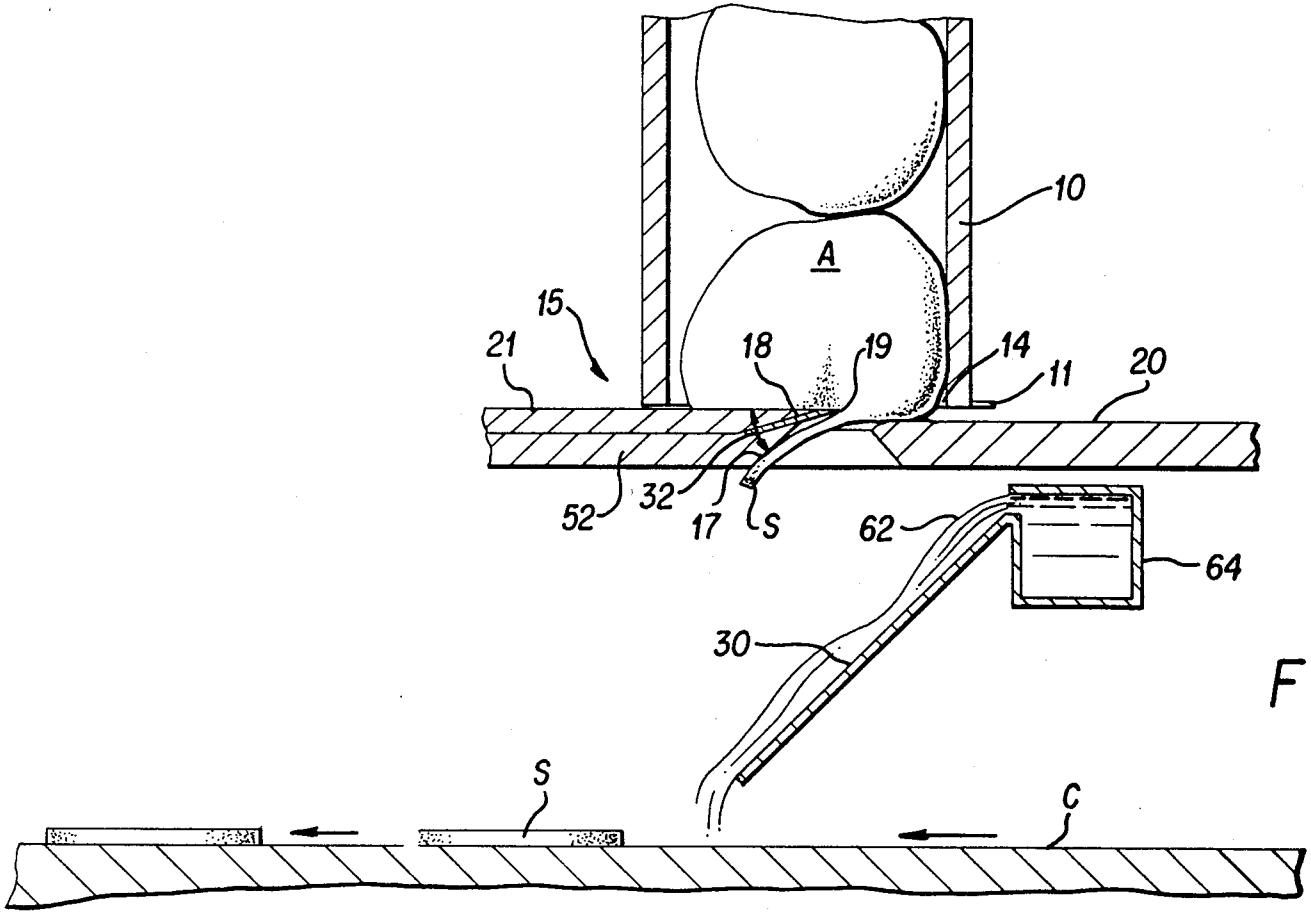
Figure 1C:
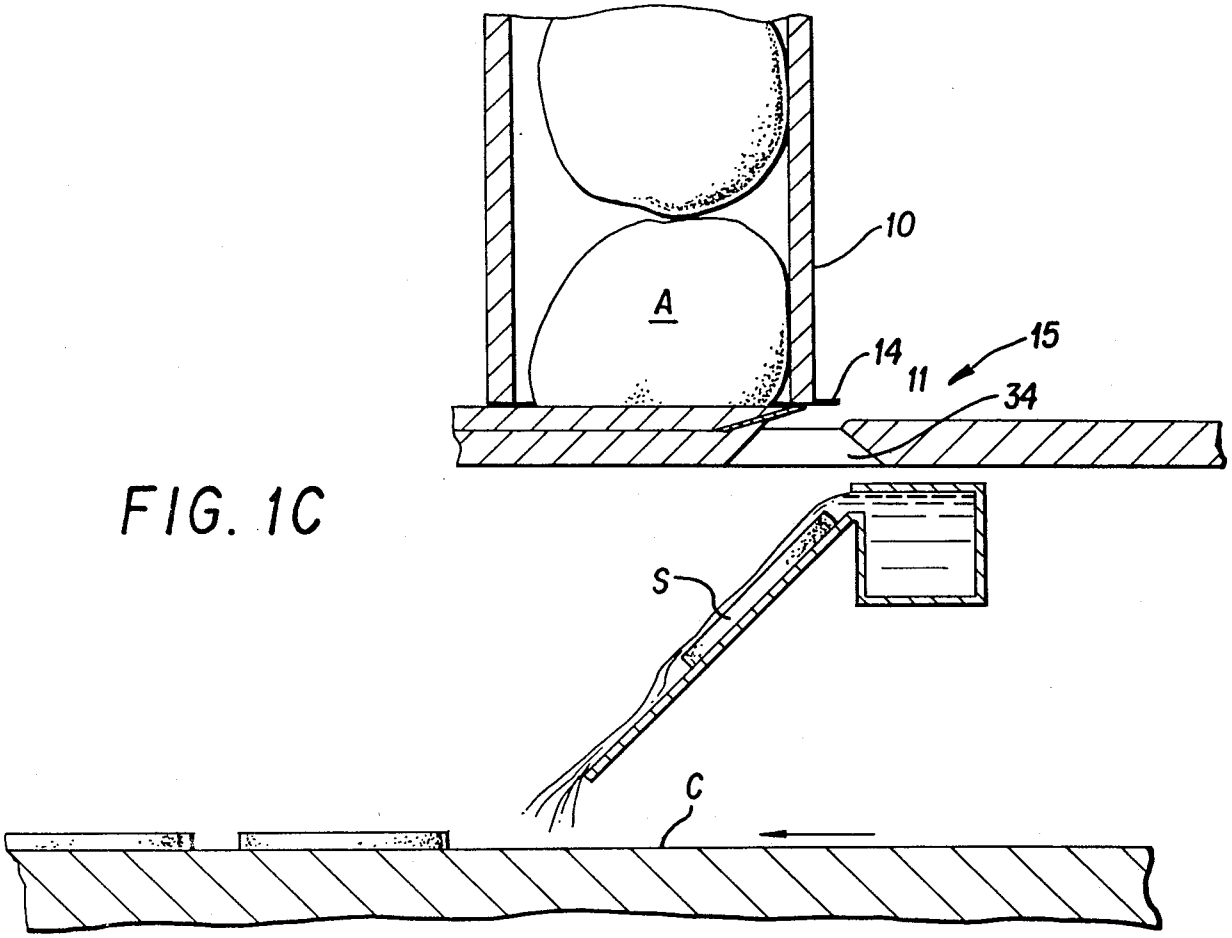

In the embodiment shown in FIGS. 1A–1C, the slicing blade assembly 15 comprised of the blade holder 16 with slicing blade 18 fixed thereto and the offset second planar surface 20 is moved past feed outlet 14 by rotation of turntable 50. Advantageously, the feed channel 12 is disposed about perpendicular to the rotational plane of turntable 50.

Turntable 50 is rotated by any suitable means such as by drive 59 shown schematically in FIG. 1A connected to turntable 50 by means of shaft 60. According to the embodiment shown in FIG. 2, a slicing blade is provided for each of guide tubes **10*a*–10*d*. One pair of slicing blades 18*a* and 18*c*, corresponding respectively to guide tubes 10*a* and 10*c*, are 180° out of phase with the other pair of slicing blades 18*b* and 18*d*, corresponding respectively to guide tubes 10*b* and 10*d*. If desired, more than one slicing blade can be provided for each of guide tubes 10*a*–10*d***.

In the embodiment shown in FIGS. 1A–1C, uniform placement of slices exiting the slicing assembly is facilitated by a sloping guide surface or slide 30 that extends downwardly beneath each guide tube 10 with the turntable rotating therebetween.

With reference to FIG. 1B, the slicing blade 18 is positioned below the feed outlet 14 at an angle relative to the feed outlet, with the cutting edge 19 of blade 18 disposed adjacent feed outlet 14. The slice discharge or throw angle 32 is defined by support surface 21 and a tapered throwing surface 17 of lower blade support member 52 extending beneath the slicing blade. Throwing surface 17 provides slice control by throwing a slice that is severed from the fruit piece towards slide 30. Angle 32 of throwing surface 17 can vary between about 15° and about 60°, depending on the thickness of the slice to be cut, for controlling the cut slice and throwing a slice towards slide 30. Generally, the thicker the slice, the lower the angle for optimal control over the slice. For example, with 0.085 inch thick apple slices, an angle of about 45° from the direction of travel of the blade assembly has been found to be suitable. The higher the speed of rotation, the smaller the angle required. At too great of an angle the sliced product tends to ripple or crack. At too slight an angle there is no control over the disposition of the slice once it has separated. Throwing surface 17 also serves as a wear plate and can be planar as illustrated or curved if desired.

A downwardly moving curtain of liquid 62 exiting manifold 64 flows over and bathes the top surface of slide 30. Slide 30 is positioned so that slices are thrown onto the top surface thereof by throwing surface 17 and captured in the downwardly moving curtain of liquid 62. The slices flow with the liquid and are deposited in a monolayer onto a moving conveyor belt C disposed beneath the slide 30. In the embodiment shown, the conveying direction is opposite that of the slicing direction. For monolayering apple slices, liquid 62 advantageously contains an anti-browning agent such as sodium bisulfite.

Figure 5:
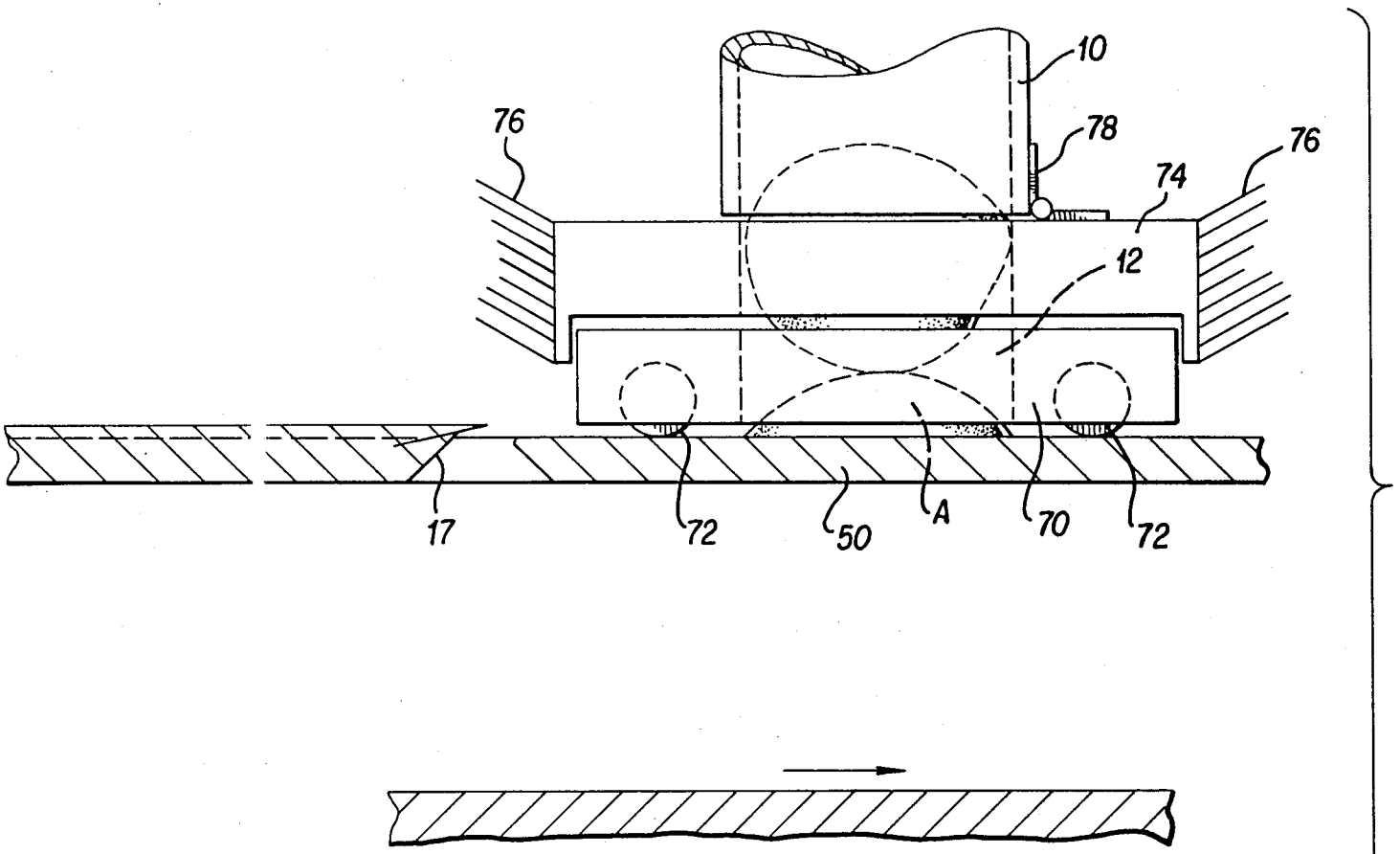
FIG. 5 is a schematic side elevation view of a rotary slicer according to the invention utilizing a floating shear bar.

Slices can be monolayered directly onto a conveyor by throwing surface 17 without a slide 30 by having the conveyor travel in the same direction as the slicing direction as shown in FIG. 5.

Referring back to FIGS. 1A–1C, the lower first support surface 20 holds the uncut whole product before it is sliced. The upper second support surface 16 is at about the same height as the cutting blade 18. Rotation of turntable 50 slices the product with the slice being thrown onto slide 30 by surface 17 to be monolayered on conveyor C, while the second (upper) planar surface supports the separated whole product. Continuous rotation of the slicing knife assembly past the feed outlet of the stationary feeding channel serially slices apples A passing through the feed outlet 14 of tube 10.

In the embodiment shown in FIG. 2, slicing blades 18*a* and 18*c* are staggered with respect to slicing blades 18*b* and 18*d* such that fruit pieces in guide tubes 10*a* and 10*c* are sliced when blades 18*a* and 18*b* pass therebeneath, followed by slicing of fruit pieces in guide tubes 10*b* and 10*d* when blades 18*b* and 18*d* pass thereunder. This results in staggered rows of slices S on conveyor C for efficient space utilization of the top surface of conveyor C with monolayered slices.

Figure 2A:
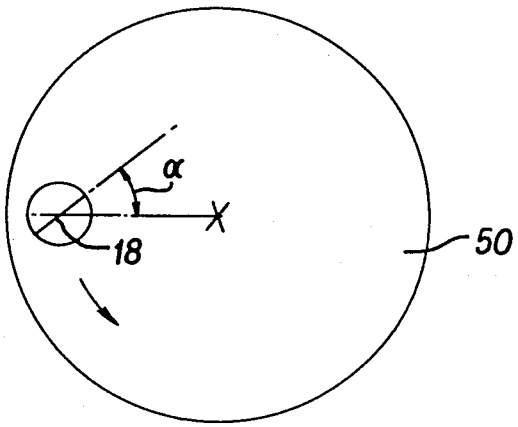
FIG. 2A is a schematic top elevation view showing a non-radially oriented cutting blade in a rotary slicer according to the invention.
Figure 2:
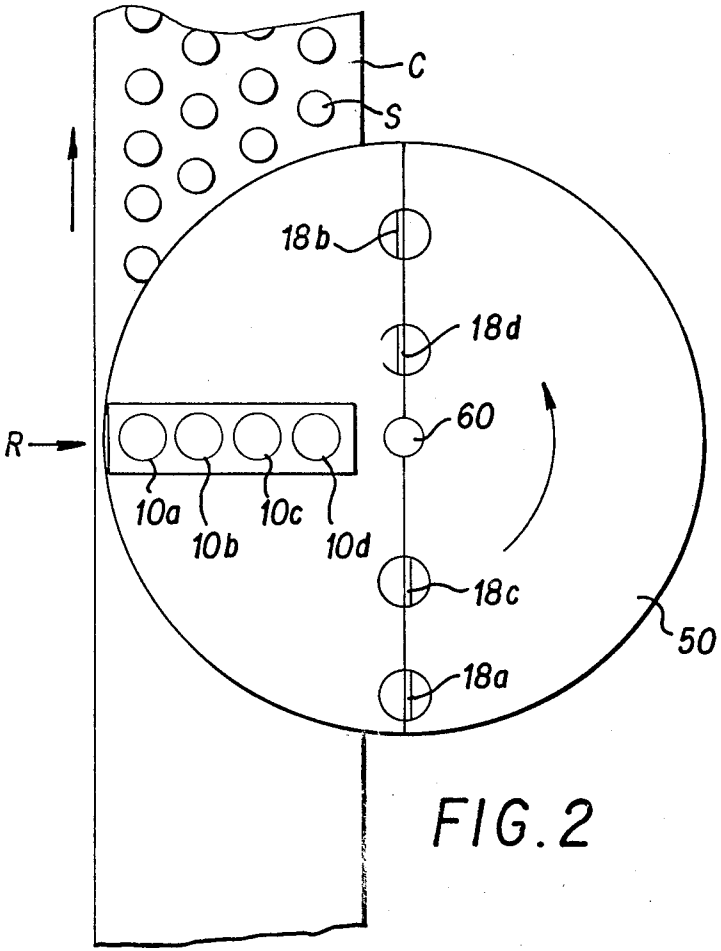
FIG. 2 is a schematic top elevation view of an embodiment of the invention employing a rotating slicing assembly with a plurality of food piece guide tubes in a row for slicing and monolayering slices.

The edges of blades 18 need not be perpendicular to the cutting direction, but can be angled to cut different products, as shown in FIG. 2A.

Figure 3:
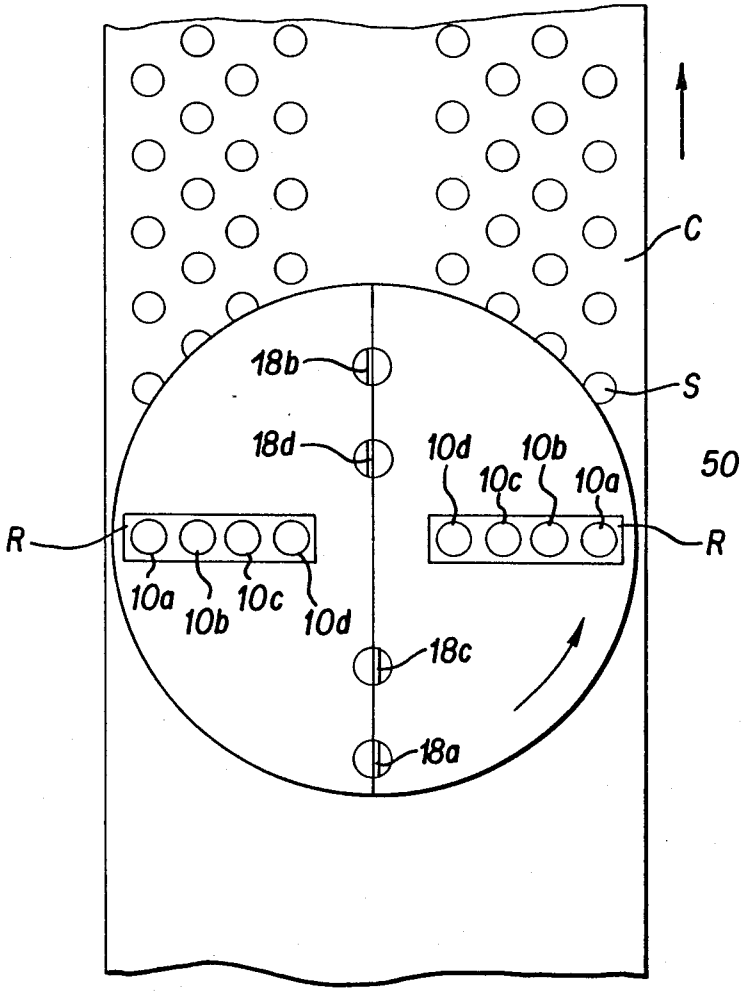
FIG. 3 is a schematic top elevation view of an embodiment of the invention employing a rotating slicing assembly with two rows of food piece guide tubes spaced 180° apart for slicing and monolayering slices.

FIG. 3 illustrates another embodiment utilizing a rotating turntable 50, wherein two rows R of four stationary guide tubes 10*a*–10*d* are mounted 180° apart over a rotating turntable 50. As in the embodiment shown in FIG. 2, a single set of two pairs of staggered slicing blades 18*a*, 18*c* and 18*b*, 18*d* are mounted on turntable 50. However, in this embodiment, conveyor C must be wide enough to pass beneath the entire turntable to capture the slices S in a monolayer.

Figure 4:
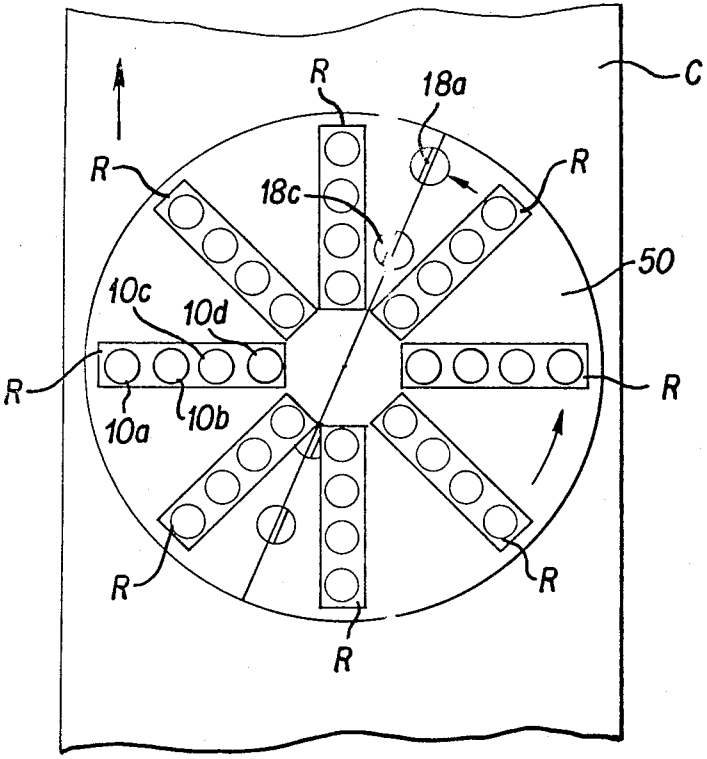
FIG. 4 is a schematic top elevation view of an embodiment of the invention employing a rotating slicing assembly with eight evenly spaced rows of food piece guide tubes non-monolayered deposition of slices.

If desired, more than two rows R of guide tubes can be provided for a single set of two pairs of staggered slicing blades 18*a*, 18*c* and 18*b*, 18*d*. FIG. 4 illustrates eight rows R of guide tubes 10*a*–10*d*, beneath which a turntable 50 rotates with a single set of respective slicing blades 18*a*–18*d* arrayed in staggered pairs. A multiple guide tube arrangement as in FIG. 4 results in non-monolayered deposition of slices on conveyor C, which is suitable for product which does not require monolayering for further processing downstream.

FIG. 5 illustrates another embodiment of the invention employing a rotating turntable 50 that utilizes a "floating shear bar" 70, for use with turntables having top surfaces with slight irregularities or that do not have completely true planar surfaces. According to this embodiment, shear bar 70 rides on wheels 72 that follow the top surface of turntable 50 as it rotates. Shear bar 70 is vertically displaceable within feed block 74 that is fixedly supported by a frame 76 so that the shear bar follows or "rides" the top surface of the rotating turntable 50. One or more guide tubes 10 are mounted on feed block 74 by means including a hinge 78, such that the feeding channel 12 passes uninterrupted from guide tube 10 through feed block 74 and shear bar 70 for slicing a food piece A. Hinge 78 permits easy access to feed block 74 and shear bar 70.

An apparatus according to yet another embodiment of the invention also includes a stationary guide tube 10 defining a feeding channel 12. See FIGS. 6A–6D. As described with respect to the above-discussed embodiment, guide tube 10 advantageously is detachable from the apparatus for cleaning. Pieces of food to be sliced, such as apples A, are serially fed through feeding channel 12 towards a feed outlet 14 adjacent a slicing assembly, the apples passing through the feed outlet 14 during slicing of the apples. The feed channel can be substantially vertical as shown, or angled off a vertical center line by, for example, up to about 60° towards the front or back of the slicer, to take advantage of gravity feeding. If desired, a plurality of guide tubes 10 can be arranged side-by-side in a row.

A slicing blade assembly 15 according to this embodiment is moved past the feed outlet 14 to slice a food piece. Slicing blade assembly 15 includes a first planar support surface 20 on which a food piece exiting the feeding channel rests prior to being cut. Support surface 20 follows a first planar path during movement of the slicing assembly 15 past feed outlet 14 to slice a food piece. The slicing blade assembly 15 includes a slicing blade 18 fixed within a blade holder 16. Slicing blade 18 has a slicing edge 19 that follows a second planar path that is adjacent the feed outlet during movement of slicing assembly 15 past feed outlet 14 to slice a food piece. The slicing edge 19 of the slicing blade 18 is beveled on a side 23 of the blade adjacent the feed outlet 14 of feeding channel 12.

Figure 6A:
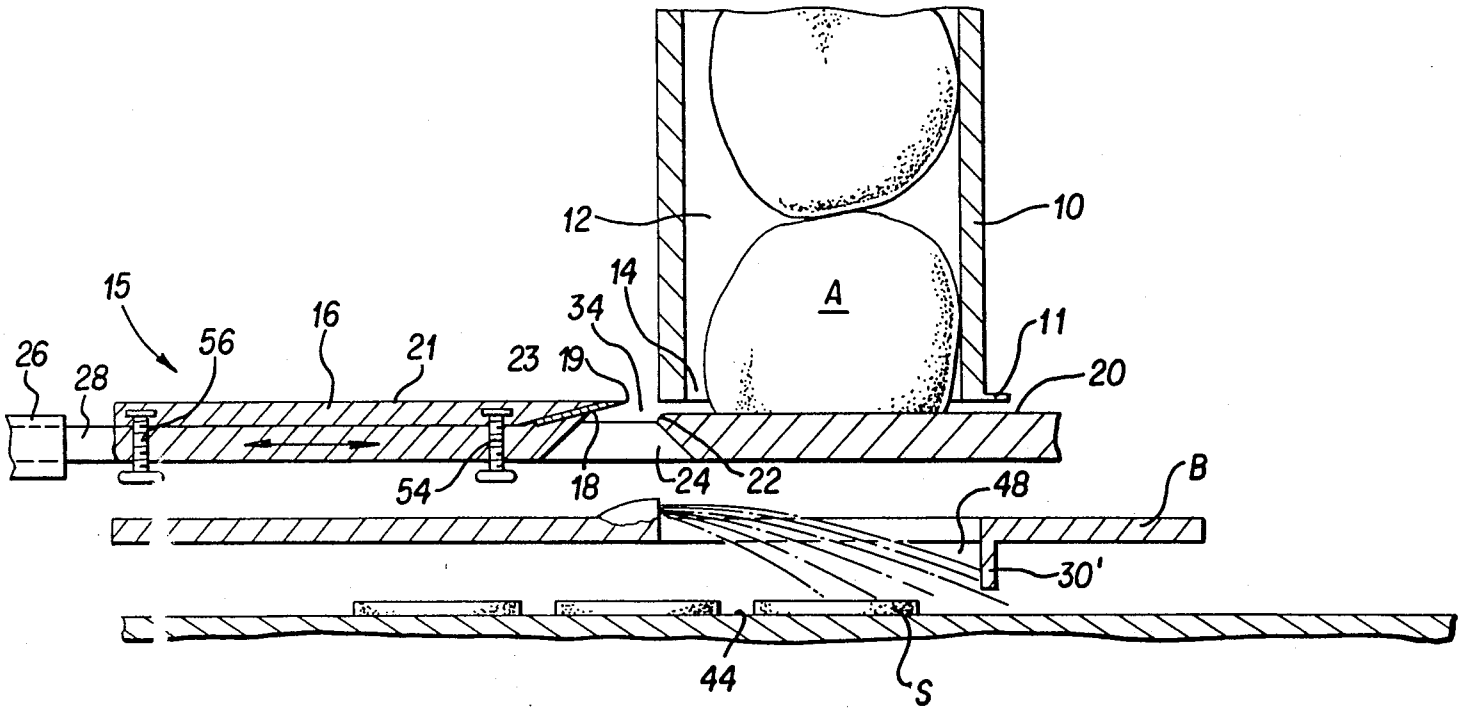
FIGS. 6A–6D are a sequence of schematic side elevation views of an apparatus according to another embodiment of the invention during the cutting and monolayering of one slice from a food piece with a reciprocating slicing assembly.

The slicing assembly 15 includes a second planar support surface 21 on which the food piece rests while a slice is being cut. During slicing, support surface 21 follows the second planar path along with blade edge 19. The slicing blade edge 19 is adjacent the feed outlet 14 and the first support surface 20 is disposed at a distance below the feed outlet 14 about equal to a desired slice thickness T, such that the first and second planar paths are parallel and separated by a distance about equal to the thickness of a slice. For varying slice thickness, the distance T between the feed outlet 14 and the first support surface 20 can be adjustable, by means of, for example, screws 54 and 56 as shown schematically in FIG. 6A. Additionally, the distance between feed outlet 14 and blade edge 19 can be adjustable using any suitable means, such as screws 56, one shown schematically in FIG. 6A. The blade holder 16 with blade 18 fixed thereto is fixedly connected to the first planar surface 20 by any suitable means, such as by connecting side members 24, one of which is illustrated in FIG. 6A. The first support surface 20 and the slicing blade 18 are spaced apart such that the distance between the first support surface and the slicing blade define a slice exit 34 through which individual slices exit the slicing assembly 15. The distance between the first support surface 20 and the slicing blade edge, which defines the slice exit, can for example be between about 1.3 and 3.3 mm (between about 0.06 and 0.1 inch).

In the embodiment shown in FIGS. 6A–6D, the slicing blade assembly 15 comprised of the blade holder 16 with slicing blade 18 fixed thereto and the offset second planar surface 21 is reciprocated past feed outlet 14 by any suitable means, such as by air cylinder 26 having a reciprocating piston 28 connected to the slicing blade assembly 15. Piston 28 of air cylinder 26 can have, for example, a four inch stroke, and reciprocate up to, for example, 250–300 times per minute. Other means, such as a reciprocating mechanical driver, can be used to reciprocate assembly 15. Advantageously, the feed channel 12 is disposed about perpendicular to the direction of reciprocating travel of slicing assembly 15.

Feed outlet 14 is defined at a rearward portion thereof by a fixed slicing shear bar 11 that supports the lower portion of tube 10 and cooperates with the slicing blade 18 to slice a food piece.

Figure 6B:
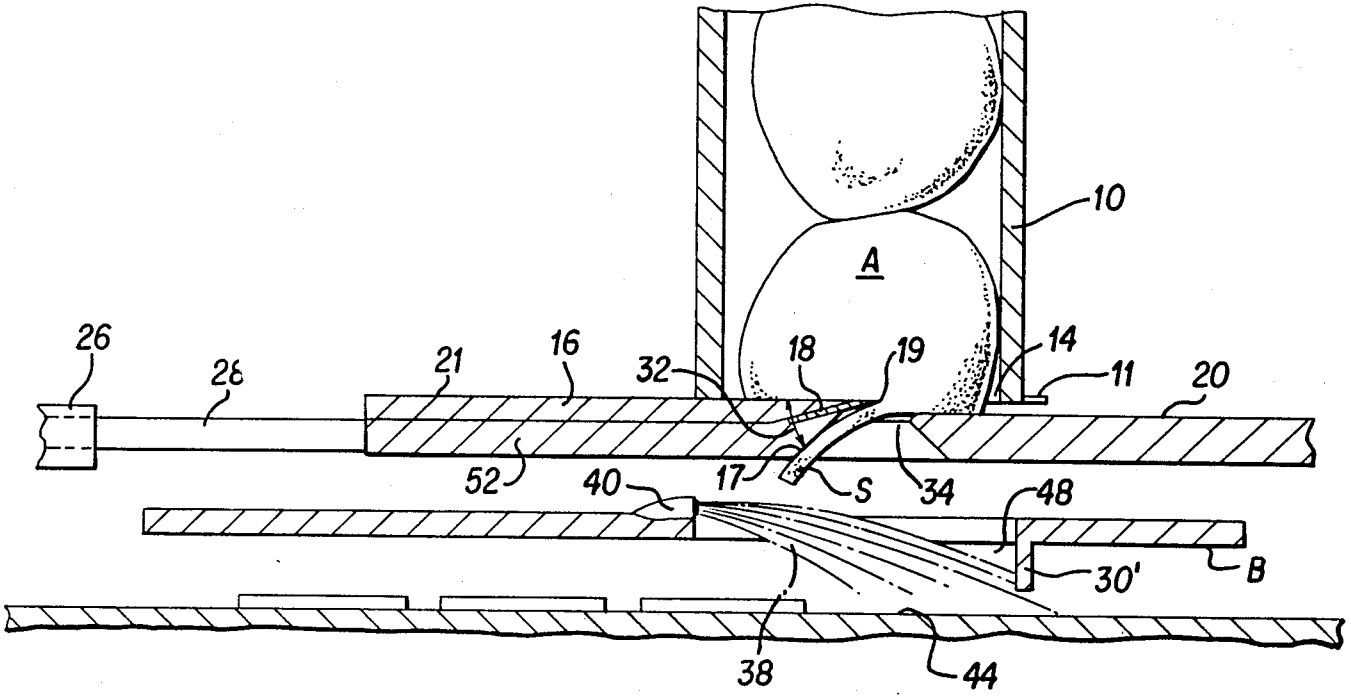
Figure 6C:
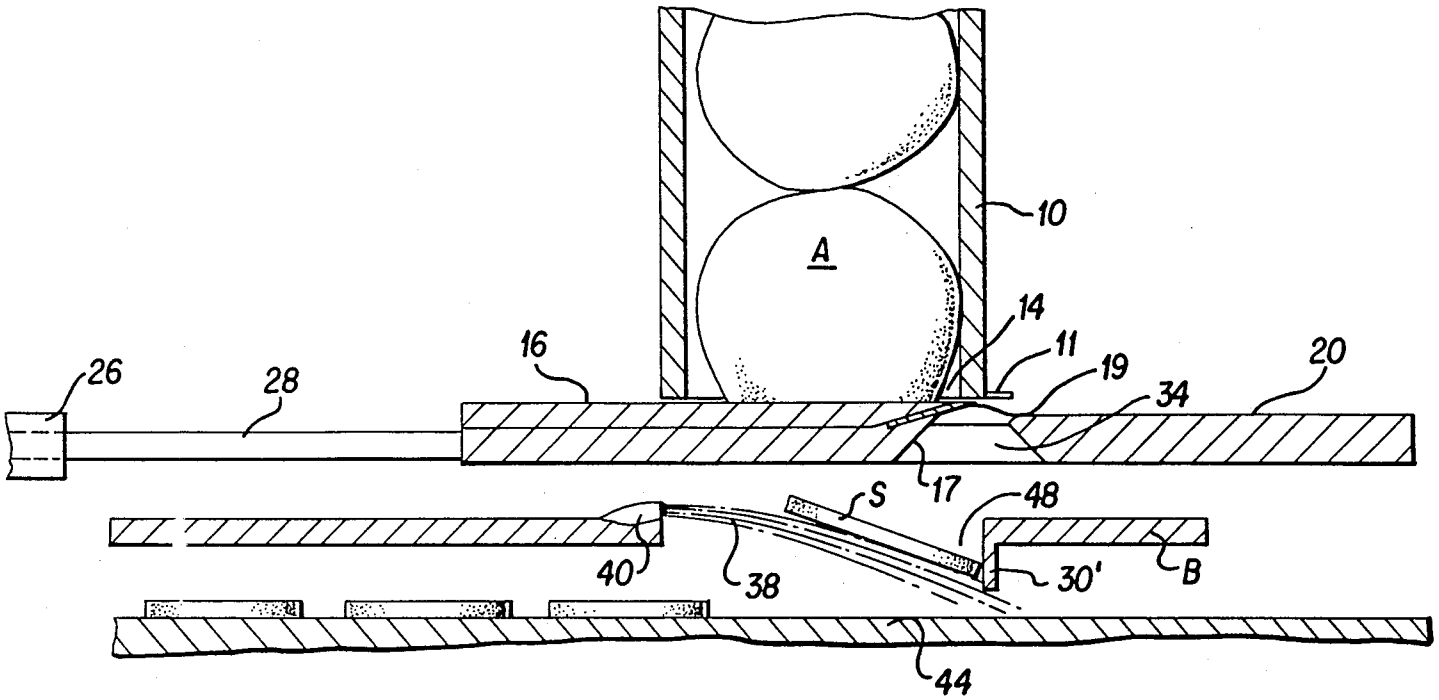
Figure 6D:
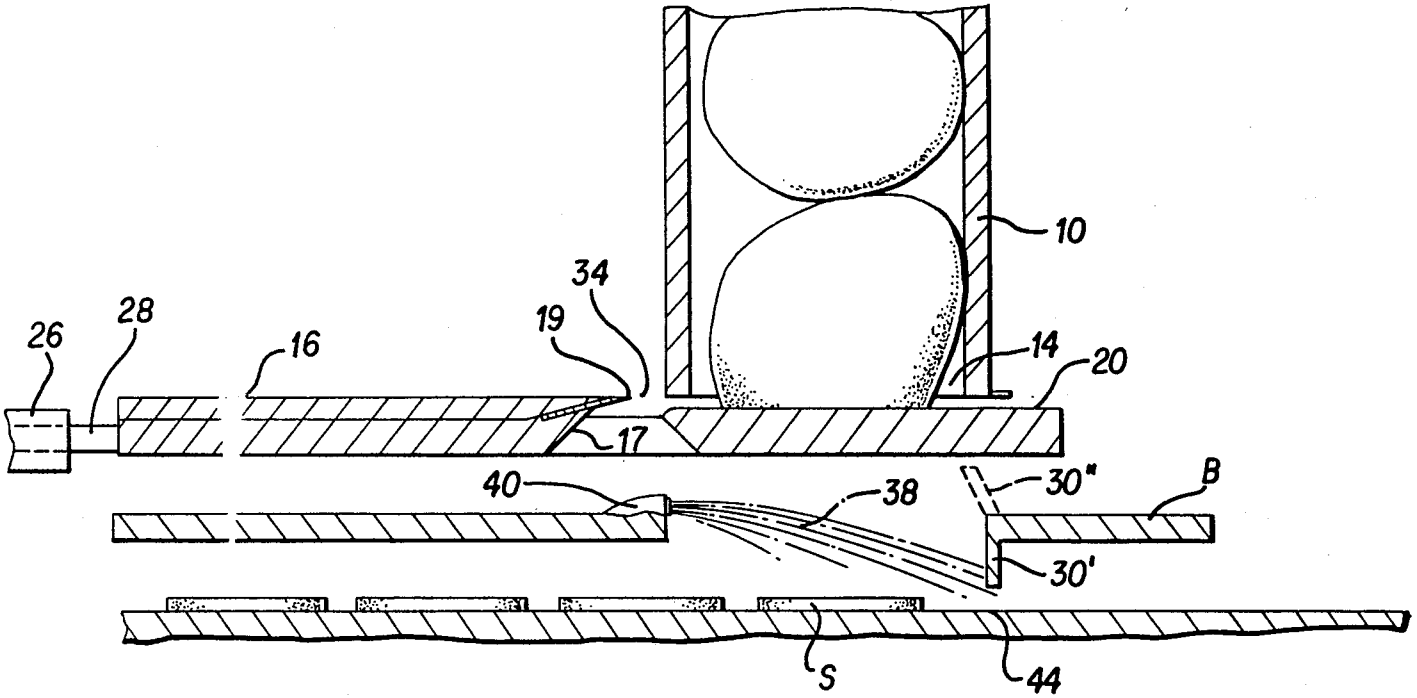

As shown in FIG. 6B, the slicing blade 18 is positioned below the feed outlet 14 at an angle relative to the feed outlet, with the cutting edge 19 of blade 18 disposed adjacent feed outlet 14. The slice discharge angle 32 is defined by support surface 21 and a tapered throwing surface 17 of lower blade support member 52 extending beneath the slicing blade. Angle 32 can vary between about 15° and about 60°, depending on the thickness of the slice to be cut, for controlling placement of a the cut slice and directing a slice. Generally, the thicker the slice, the lower the angle for optimal control over the slice. For example, with 0.085 inch thick apple slices, an angle of about 45° from the direction of travel of the blade assembly has been found to be suitable. At too great of an angle the sliced product tends to ripple or crack. At too slight an angle there is no control over the disposition of the slice once it has separated. Throwing surface 17 also serves as a wear plate and can be planar as illustrated or curved if desired.

For providing uniform placement of slices exiting the slicing assembly, a stationary guide surface such as guide bar 30' can be provided. Guide bar 30' can be generally vertically oriented as illustrated, extending downwardly beneath a support base B above which slicing assembly 15 reciprocates. Alternatively, guide bar 30' can be angled instead of vertical, as in the above-discussed rotary embodiment, and can be flushed with liquid if desired. The bar 30' is positioned to contact slices thrown by the throwing surface 17, and uniformly align the slices to fall onto endless conveyor belt 44 in a monolayer, the slices being thrown against the guide bar 30' after being severed and prior to falling onto conveyor 44. See FIGS. 6C and 6D.

In operation, the lower first support surface 20 holds the uncut whole product before it is sliced. The upper second support surface 16 is at about the same height as the cutting blade 18. Actuation of air cylinder 26 slices the product with the slice being carried under blade 18 while the second (upper) planar surface supports the separated whole product. Air cylinder 26 then returns the slicing knife assembly to the position shown in FIG. 6A, and the slicing process is repeated. Repeated reciprocation of the slicing knife assembly past the feed outlet of the stationary feeding channel by means of air cylinder 26 serially slices apples A passing through the feed outlet 14 of tube 10.

FIGS. 6A–6D further illustrate means for providing a moving stream of liquid positioned below the slice exit 34 to contact a slice after passing through the slice exit.

According to this embodiment, a moving elongate stream or sheet of liquid 38 exits under pressure from one or more openings in liquid chamber 40, which chamber is supplied liquid under pressure from a source not shown. The moving stream of liquid passes beneath the slice exit 34 in position to contact the slices and carry them to conveyor 44. The slices are serially and separately thrown against guide bar 30'. If desired, guide bar 30'' can extend above base B as shown in phantom lines in FIG. 6D. The slices are contacted by the liquid stream 38 and are directed onto a moving porous conveyor belt 44 where the slices are deposited in a monolayer for further processing such as drying. For forming apple chips from apple slices, the moving stream of fluid 38 advantageously contains an anti-browning agent such as sodium bisulfite.

The embodiments of the present invention, utilizing a blade fixed in a moving slicing assembly with offset planar support surfaces and a stationary feeding channel, slices rounded (non-elongate) food pieces in a substantially more uniform manner and with much less waste than devices which reciprocate a feeding channel containing food pieces past a rotating or vibrating knife angularly projecting above a uniformly planar slicing table. The planar support surfaces in different planes also promote slice uniformity by preventing "wobble" of the fruit piece during slicing. Furthermore, the throwing surface of the present invention provides for uniform monolayering of the slices on a conveyor beneath the slicing assembly. For gravity feed of food pieces such as apples through tube 10, slice thickness uniformity is optimized with at least about 18 inches of apples or round product in the tube.

Since many modifications, variations and changes in detail may be made to the described embodiments, it is intended that all matter in the foregoing description and shown in the accompanying drawings be interpreted as illustrative and not in a limiting sense.

What is claimed is:

1. An apparatus for slicing a food piece and monolayering food piece slices on a conveyor, comprising:

(a) at least one stationary feeding channel for serially feeding food pieces, the feeding channel having a feed outlet through which a food piece passes prior to slicing thereof;

(b) a moving conveyor belt disposed below said feed outlet (c) at least one moving slicing assembly that includes a first substantially planar support surface on which the food piece exiting the feed outlet rests prior to a slice being cut, the first substantially planar support surface disposed at a distance below the feed outlet about equal to the desired slice thickness; a fixed slicing blade having a cutting edge maintained at a set distance from said first supporting surface and adjacent to said feed outlet to sever a slice from the food piece; the slicing blade being disposed at an angle with respect to said feed outlet, the distance between the first support surface and the edge of the slicing blade defining a slice exit through which individual slices exit the slicing assembly; a blade holder having a second substantially planar support surface contingent to and extending over a portion of said slicing blade and extending in an opposing direction from said first support surface, on which second planar surface said food piece rests while a slice is being cut, the cutting edge of the slicing blade being in the plane of said second planar surface, a slice-throwing surface extending from the slicing blade in the vicinity of the slice exit with a portion of the slicing blade disposed between the slice-throwing surface and the second planar surface, the slice-throwing surface being at an acute angle relative to second planar surface for throwing slices away from the slice exit during movement of the slicing assembly and monolayering said slices on said moving conveyor belt; and (d) means for moving the slicing blade in a cutting direction past the feed outlet to serially slice a food piece into individual slices and to throw the slices away from the slice exit with the slice-throwing surface so as to monolayer said slices on said moving conveyor belt.

2. The apparatus of claim 1 wherein said feed channel includes a shear bar disposed at said feed outlet.

3. The apparatus of claim 1 wherein said feed channel is disposed about perpendicular to the direction of travel of said slicer assembly.

4. The apparatus of claim 1 wherein the distance between said feed outlet and said first support surface is adjustable.

5. The apparatus of claim 1 wherein the distance between said feed outlet and said adjacent slicing blade is adjustable.

6. The apparatus of claim 1 wherein said slice-throwing surface extends at an acute angle of between about 15° and 60° from the direction of travel of said blade assembly.

7. The apparatus of claim 6 wherein said acute angle is about 45°.

8. The apparatus of claim 1 wherein the distance between the first support surface and the slicing blade which defines the slice exit is between 1.3 millimeters and 3.3 millimeters.

9. The apparatus of claim 1 further including a guide surface disposed below said slice exit to guide said slices for uniform monolayering of said slices.

10. The apparatus of claim 1 further including a liquid dispensing means beneath said slicer assembly for wetting slices with a liquid as they exit said slicer assembly.

11. The apparatus of claim 9 wherein said guide surface is stationary, angled slide having a liquid-bathed upper surface that is positioned below the slice exit and above the conveyor for capturing slices thrown by the throwing surface and monolayering the slices on the conveyor passing beneath the slide.

12. The apparatus of claim 1 wherein the edge of the slicing blade is perpendicular to the slicing direction.

13. The apparatus of claim 1 wherein the edge of the slicing blade is angled with respect to the slicing direction.

14. The apparatus of claim 1 wherein the conveyor passes beneath the slice exit in a direction opposite the cutting direction of said blade.

15. An apparatus for slicing a food piece and monolayering food piece slices on a conveyor, comprising:

(a) at least one stationary feeding channel for serially feeding food pieces, the feeding channel having a feed outlet though which a food piece passes prior to slicing thereof;

(b) at least one moving slicing assembly that includes a first substantially planar support surface on which the food piece exiting the feed outlet rests prior to a slice being cut, the first substantially planar support surface disposed at a distance below the feed outlet about equal to the desired slice thickness; a fixed slicing blade having a cutting edge maintained at a set distance from said first support surface and adjacent to said feed outlet to sever a slice from the food piece; the slicing blade being disposed at an angle with respect to said feed outlet, the distance between the first support surface and the edge of the slicing blade defining a slice exit through which individual slices exit the slicing assembly; a blade holder having a second substantially planar support surface contingent to and extending over a portion of said slicing blade and extending in an opposing direction from said first support surface, on which second planar surface said food piece rests while a slice is being cut, the cutting edge of the slicing blade being in the plane of said second planar surface, a slice-throwing surface extending from the slicing blade in the vicinity of the slice exit with a portion of the slicing blade disposed between the slice-throwing surface and the second planar surface, the slice-throwing surface being at an acute angle relative to said second planar surface for throwing slices away from the slice exit during movement of the slicing assembly;

(c) means for rotating the slicing assembly to move the slicing blade in a slicing direction past the feed outlet to serially slice a food piece into individual slices and to throw the slices away from the slice exit with the slice-throwing surface;

(d) a conveyor belt beneath the slice exit traveling in a direction opposite the slicing direction of the slicing blade; and (e) a stationary, angled guide surface bathed with downwardly flowing liquid, the guide surface being positioned between the slice exit and the conveyor for capturing slices thrown by the throwing surface in the downwardly flowing liquid and monolayering the slices on the conveyor.

16. The apparatus of claim 15 wherein said feed channel includes a vertically movable shear bar disposed at said feed outlet.

17. The apparatus of claim 15 wherein said feed channel is disposed about perpendicular to the direction of travel of said slicer assembly.

18. The apparatus of claim 15 wherein the distance between said feed outlet and said first support surface is adjustable.

19. The apparatus of claim 15 wherein the distance between said feed outlet and said adjacent slicing blade is adjustable.

20. The apparatus of claim 15 wherein said slice-throwing surface extends at an acute angle of between about 15° and 60° from the direction of travel of said blade assembly.

21. The apparatus of claim 20 wherein said acute angle is about 45°.

22. The apparatus of claim 15 wherein the distance between the first support surface and the slicing blade which defines the slice exit is between 1.3 millimeters and 3.3 millimeters.

23. The apparatus of claim 1 wherein the conveyor passes beneath the slice exit in a direction the same as the cutting direction of the blade.

24. The apparatus of claim 15 including a plurality of said feeding channels in a row, and a plurality of said slicing assemblies corresponding to said plurality of feeding channels, said plurality of slicing assemblies being positioned in a staggered arrangement on the slicing assembly-rotating means for monolayering the slices on the conveyor.

* * * * *